United States Patent [19]

Jeppson

[11] 4,252,487

[45] Feb. 24, 1981

[54] MICROWAVE METHOD AND APPARATUS FOR HEATING PAVEMENTS

[75] Inventor: Morris R. Jeppson, Carmel, Calif.

[73] Assignees: Microdry Corporation, San Ramon, Calif.; Giselle V. Laurmann, Carmel, Calif.; Richard R. Blurton; Claire M. Blurton, both of Incline Village, Nev. ; part interest to each

[21] Appl. No.: 921,072

[22] Filed: Jun. 30, 1978

Related U.S. Application Data

[63] Continuation-in-part of Ser. No. 756,365, Jan. 3, 1977, abandoned.

[51] Int. Cl.[3] ..... E01C 7/06

[52] U.S. Cl. ..... 404/77; 404/79; 404/95

[58] Field of Search ..... 414/77, 95, 90, 91, 414/92, 79, 102; 126/271.1, 19.5, 275 E; 328/7

[56] References Cited

U.S. PATENT DOCUMENTS

| | | | |
|---|---|---|---|
| 1,247,271 | 11/1917 | Hines | 404/77 |
| 1,921,688 | 8/1933 | McLaughlin | 404/92 |
| 1,984,849 | 12/1934 | Van Allen | 404/95 X |
| 2,335,961 | 12/1943 | Pick | 126/19.5 X |
| 2,644,558 | 6/1936 | Ball | 404/94 X |
| 2,898,825 | 8/1959 | Walker | 404/94 X |
| 3,472,200 | 10/1969 | Gerling | 118/5 |
| 3,601,448 | 8/1971 | Stone | 299/14 |
| 3,843,274 | 10/1974 | Gutman | 404/91 |
| 3,874,366 | 4/1975 | Cutler | 404/75 X |
| 4,124,325 | 11/1978 | Cutler | 404/75 |
| 4,129,398 | 12/1978 | Schoelkopf | 404/90 X |

FOREIGN PATENT DOCUMENTS

| | | |
|---|---|---|
| 1096573 | 12/1967 | United Kingdom . |
| 1216654 | 12/1970 | United Kingdom . |
| 1226601 | 3/1971 | United Kingdom . |

OTHER PUBLICATIONS

"Microwave Heating For Road Maintenance," Syracuse Univ. Research Corp., 3/76.

"The Journal of Microwave Power"-Canada, 9(4)-1974; By Bosisio, Spooner, Granger.

*Primary Examiner*—Nile C. Byers, Jr.

*Attorney, Agent, or Firm*—Phillips, Moore, Weissenberger, Lempio & Majestic

[57] ABSTRACT

Pavement (12) is rapidly heated in depth by irradiation with microwave energy accompanied by supplemental surface heating which counteracts an inverted temperature gradient otherwise produced by microwave heating. Energy efficiency is increased by performing the surface heating with thermal energy derived from the exhaust gases of a motor (19) which drives a generator (18) to energize the microwave source (68). An energy applicator (36) simultaneously applies both the microwave energy and hot gas to a selected area of pavement while blocking release of microwave energy in upward and outward directions and is preferably attached to a mobile support (37) through support and positioning linkage (38) which enables shifting of the applicator between localized areas of pavement to be heated. A variety of paving operations and pavement repair operations are facilitated by enabling an efficient deep rapid heating of deteriorated pavement or surfaces to be paved or repaved or to which an additional layer of pavement is to be applied.

20 Claims, 10 Drawing Figures

CROSS SECTION OF HEATED STRIP OF ASPHALTIC CONCRETE PAVEMENT ALONG JOINT BETWEEN TWO LANES SHOWING TYPICAL TEMPERATURE ISOTHERMS VS. DEPTH AFTER HEATING BY MICROWAVE AND HOT EXHAUST GAS

Microwave input: 20 kw/sq ft. for 4 minutes (215 kw/meter$^2$)

CROSS SECTION AFTER RECYCLING OLD MATERIAL IN PLACE OR AFTER REPLACING OLD MATERIAL WITH NEW HOT-MIX

VI
VI
VIII
VIII
52
53
36
137
118
58
68
55
64
116
119
112
99
111
113
113'
98
38
34
116a
94
101
129
89
128
97
49
37
40
127
43
126
124
96'
96
69
74
73
91
92
93
94
106
101
104
103
109
108
107
102
111
114
128
43
38
91

MICROWAVE METHOD AND APPARATUS FOR HEATING PAVEMENTS

CROSS-REFERENCE TO RELATED APPLICATION

This application is a continuation-in-part of copending U.S. Application Ser. No. 756,365 of Morris R. Jeppson, filed Jan. 3, 1977 and entitled Microwave Method and Apparatus for Reprocessing Pavements said application Ser. No. 756,365 having been abandoned following filing on Oct. 4, 1978 of application Ser. No. 948,503 which is a continuation of application Ser. No. 756,365.

TECHNICAL FIELD

This invention relates to the maintenance of pavements and more particularly to a method and apparatus utilizing microwave energy for heating pavements or the like in depth in conjunction with localized pavement repair operations.

BACKGROUND OF THE INVENTION

Paved surfaces deteriorate after a period of time from a variety of causes which may include the freezing and thawing of moisture which collects in cracks, impacts and wear from vehicles, ground settlement and thermal expansion and contraction. Complete repaving of an extensive deteriorated surface is a costly operation and may require large quantities of petroleum based asphalt or other materials which have recently become scarce. Consequently, the maintenance of roadways and other paved surfaces is increasingly becoming a matter of repairing localized small deteriorated areas where that is possible. This may variously involve filling cracks, potholes or other declivities with new paving material or patching compounds, the limited repaving of separate localized small areas that exhibit such defects, or the addition of a relatively thin overlayer of paving to such areas.

Many localized pavement repair operations of these or other kinds involve heating of the pavement or the surface to be paved or are at least more effective if the area being treated is heated to a depth of several centimeters or more. In repairing asphaltic concrete, for example, better bonding of patch material or new or recycled pavement material to adjacent portions of the pre-existing pavement may be achieved if the old pavement is heated in depth during such repairs. In the case of Portland cement concrete, in-depth heating of the pavement adjacent to a crack or other declivity to be patched with materials such as polymerizable patching compounds provides a better bond and may also promote more rapid and uniform curing of the patch material.

Conventional techniques for heating a paved surface are subject to serious problems. Combustion heaters, infrared heaters or the like apply direct heat only to the surface of the pavement. It is then necessary to rely on the slow process of downward heat conduction to raise the temperature of subjacent regions of the pavement. A severe downward temperature gradient is produced unless the heating period is undesirably prolonged to allow for a gradual distribution of heat by conduction. In order to raise the temperature of the deeper regions of the pavement to a desired extent, it may be necessary to heat the surface region more intensely than is desirable. The overheating of the surface may itself cause deterioration. Ignition of asphalt and related problems, such as smoke pollution, may also be encountered. Overheating of the top portion of the pavement in order to adequately heat the deeper portions is also undesirable in that it is an inefficient use of scarce energy resources.

Use of these conventional heating techniques in conjunction with the localized repair of deteriorated pavement usually results in poor bonding of added patch material or remixed existing pavement material to the adjacent portions of the old pavement. As a practical matter, most existing pavement patches in cracks, potholes or the like tend to be very poorly bonded to the adjacent old pavement and the end result is rapid deterioration of the pavement.

It has recently been recognized in the art that the problems discussed above may be greatly reduced or eliminated by using microwave energy to heat localized areas of pavement in depth in conjunction with repair operations. Microwave energy, which is not itself heat energy, penetrates virtually instantaneously into pavement to depths of several centimeters or more and converts to heat throughout the penetrated volume of pavement by electrical interaction with dielectric constituents of the pavement, most notably by interaction with the rock aggregate content. The result is a rapid and relatively uniform heating of the pavement to substantial depths. An area of asphaltic concrete exhibiting one or more cracks, potholes or the like may be rapidly decomposed into a semi-liquid condition and the constituents, together with new materials which may be added in, may then be remixed and recompacted. Similarly, by heating Portland cement concrete pavements in depth with microwave energy, the curing of polymer patching compounds and the like may be facilitated and improved bonding of the patch material to the concrete is achieved.

As heretofore practiced, pavement repair using microwave heating has been subject to a serious inefficiency from the standpoint of energy use which, in addition to being undesirable in itself, also adversely affects costs. The energy which ultimately appears as heat within the pavement is initially produced by consuming some form of fuel in motor generator means which supply electrical energy to energize the microwave sources. While the motors which drive the generators may variously be diesel engines, gasoline engines, turbines or the like, it is a characteristic of such engines in general that typically around 70% of the energy content of the consumed fuel is discharged as exhaust gas heat or is otherwise dissipated in an unproductive manner.

Disadvantages of known methods for heating pavements in place with microwave energy are not limited to an energy inefficiency. Microwave heating of pavement by known techniques also produces a temperature gradient in the pavement but it is a reversed gradient relative to the gradient produced by conventional pavement heating techniques. In particular, microwave irradiation tends to heat a deeper region of the pavement more strongly than it heats the surface region. The inverted temperature gradient is believed to arise in part from evaporation of moisture which is driven to the pavement surface by microwave heating and other modes of cooling such as heat transfer to ambient air are also more pronounced at the pavement surface, particularly during cold weather.

Although the temperature gradient produced by microwave heating tends to be less severe than the opposite temperature gradient produced by more conventional forms of pavement heating, a still more uniform heating effect is desirable. In addition, some forms of pavement such as old asphaltic concrete tend to have a hard dry crust of the order of several millimeters thick which is believed to be caused by the evaporation over a period of time of the more volatile components of the asphalt binder. Where this condition is encountered in pavement to be repaired, somewhat stronger heating of the surface, relative to the deeper regions of the pavement, would be desirable in order to decompose the crust.

My copending U.S. application Ser. No. 756,365, filed Jan. 3, 1977, and entitled Microwave Method and Apparatus for Reprocessing Pavements, discloses methods and apparatus which reduce or eliminate the problems discussed above. While apparatus disclosed in copending application Ser. No. 756,365, may be used for the repair of specific small localized areas of deteriorated pavement, most of the disclosed systems are primarily designed for large scale reprocessing of lengthy strips of pavement including performing the heating and other operations while traveling continuously along a roadway or the like. A need also exists for less complex and costly apparatus and procedures specifically designed for stationary patching, repaving or other repair operations at relatively small separated deteriorated areas of an expanse of pavement.

DISCLOSURE OF INVENTION

In one aspect of the present invention, pavement is heated by directing microwave energy downward into the pavement to generate heat within the pavement, including within the subsurface region thereof, while also applying thermal energy to the surface of the pavement to supplement the microwave heating of the uppermost region of the pavement.

In another aspect of the present invention, apparatus for heating pavement and/or paving materials in place on a surface has energy applicator means which may be positioned over a selected area of the pavement to be heated in order to generate heat within the interior of the pavement by microwave irradiation and is further provided with surface heating means for applying additional heat directly to the surface of the pavement over which the applicator means is disposed.

In still another aspect of the invention, pavement heating costs are reduced and more efficient use of energy resources is realized in connection with the microwave heating of pavement, by using thermal energy from the exhaust gases of one or more fuel consuming motors which drive the electrical generation means that energize the microwave sources to perform the supplemental surface heating of the pavement.

By boosting the microwave heating of pavement in depth with direct supplemental heat applied to the pavement surface, the inverted temperature gradient otherwise produced by microwave energy may be reduced, eliminated or reversed according to the requirements of the particular paving operation. Surface cooling is inhibited and a more precise control of temperature conditions in pavement repair operations is realizable. In the form of the invention where the surface heating is accomplished with thermal energy derived from the exhaust gases of the motor generators which power the microwave sources, substantial cost economies and a significant conservation of scarce energy resources is realized.

The invention greatly facilitates a variety of different types of paving repair. Localized deteriorated areas of asphaltic concrete or other thermoplastic pavements having cracks, potholes or the like may be quickly and deeply decomposed by the combined microwave and surface heating and may then be remixed and recompacted while still in the heated state. Supplemental paving material may be disposed in the cracks and potholes or distributed in a layer on the surface to be heated along with the old pavement. Bonding of a localized reprocessed area of this kind to the adjacent untreated pavement is stronger if only the central area of the heated and decomposed pavement is remixed with a border region of the heated area being left intact. Alternately, the method and apparatus may be used to heat deteriorated old pavement prior to the filling of cracks and potholes with fresh hot mix or other patching materials thereby assuring strong bonding to the added material. The method and apparatus may also be used to heat other forms of concrete, in which cracks and declivities are filled with polymer patching compounds or the like and may be used in paving repairs which include the overlaying of new or reclaimed paving materials on old deteriorated pavements.

The invention, together with further objects and advantages thereof, will best be understood by reference to the following description of preferred embodiments in conjunction with the accompanying drawings.

BRIEF DESCRIPTION OF THE DRAWINGS

FIG. 4A is a diagrammatic cross-section of adjoining portions of two separately laid strips of asphaltic concrete of a roadway and showing temperature isotherms within the pavement following heating by a typical embodiment of the present invention, while

BEST MODES FOR PRACTICING THE INVENTION

Figure 1:
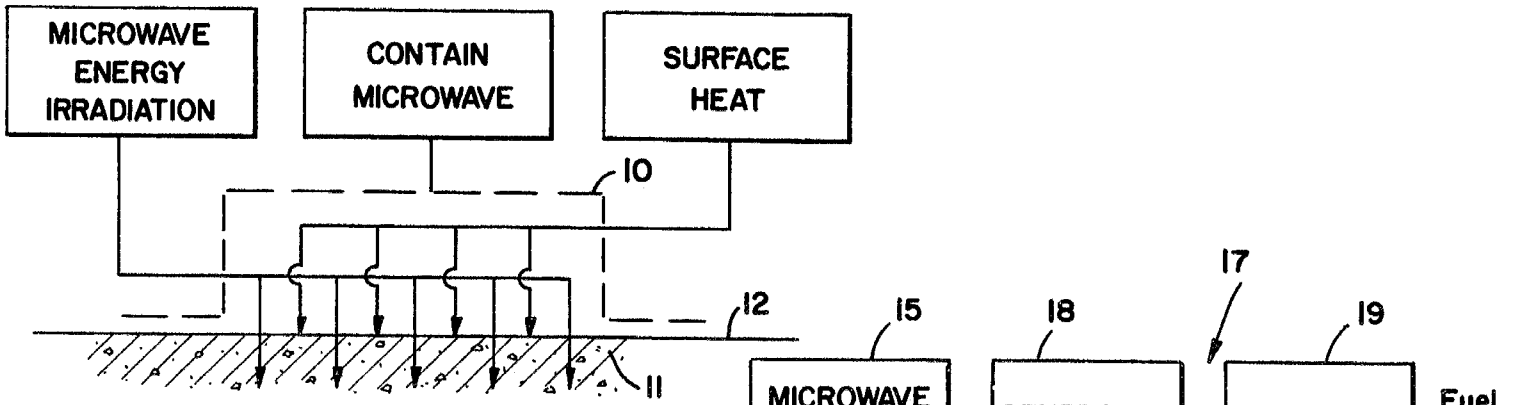
FIG. 1 is a diagrammatic illustration of steps utilized in the practice of an embodiment of the invention for heating pavement or the like in conjunction with repairs or other operations.

Referring initially to FIG. 1, rapid and relatively uniform in-depth heating of a selected area of pavement 11 is accomplished by a combination of heating steps. Microwave energy is directed downward into the selected area including into the subsurface regions of the pavement and thermal energy is applied directly to the surface 12 of the selected area. The application of supplementary heat to the surface 12 acts in part to counteract a tendency of the microwave heating to underheat the immediate surface region of the pavement and in part to inhibit cooling effects at the surface which otherwise are more pronounced at the surface than at greater depths within the pavement. During the heating operations, a containment region 10 is established at the selected area of pavement to block propagation of the microwave energy in upward and outward directions. The above described combination of steps heats the pavement 11 much more rapidly and relatively more uniformly than older methods which rely wholly on the downward conduction of heat and makes it more practical to heat the pavement deeply where that is desirable.

The step of applying additional thermal energy directly to the pavement surface 12 may be accomplished by any of a variety of surface heating techniques, such as by utilizing combustion heaters or infrared heaters for example, but is preferably performed by maintaining a hot gas environment at the surface 12. As will hereinafter be discussed in more detail, the means used to establish a microwave containment region immediately above the pavement may also be used to define a hot gas region adjacent the pavement surface.

Process conditions, such as microwave power levels and gas temperatures, may vary considerably depending on the type of pavement 11 to be heated and the nature of the repair or paving operations to be performed at the heated pavement. Thus, the specific values for certain process conditions to be hereinafter described should be recognized to be illustrative of specific examples rather than being limitative of all modes of practicing the method.

While a wide range of microwave frequencies will generate heat in pavements, primarily by interaction with the rock aggregate content, the actual frequency to be employed is usually determined by governmental regulations which assign certain specific frequencies to certain specific types of usages. In the United States of America at this time, the two frequencies of 915 MHz and 2450 MHz are the assigned frequencies for industrial applications of microwave energy, but other frequencies may be used where permitted by local regulations. The intensity of the microwave irradiation of the pavement 11 in terms of power per unit area determines heating time but is subject to practical limits. Higher intensities require more costly microwave generation equipment and larger electrical generation facilities to energize the microwave sources. For purposes of example, the application of 50 kilowatts of microwave energy distributed substantially uniformly over a pavement area measuring 3.5 by 4 feet (1.05 m by 1.20 m), accompanied by the application of hot gas at a temperature of 400° F. (204° C.) typically produces a temperature of 220° F. (104° C.) at a two-inch depth and surface temperatures from 275° F. (135° C.) to 390° F. (199° C.) in asphaltic concrete after periods of twenty to twenty-five minutes. A substantially similar temperature at a similar depth in similar pavement is produced in only four minutes by applying microwave energy at an intensity of 20 kilowatts per square foot (215 kw/meter 2), accompanied by the application of hot gas to the surface at a temperature of 400° F. (204° C.).

Figure 2:
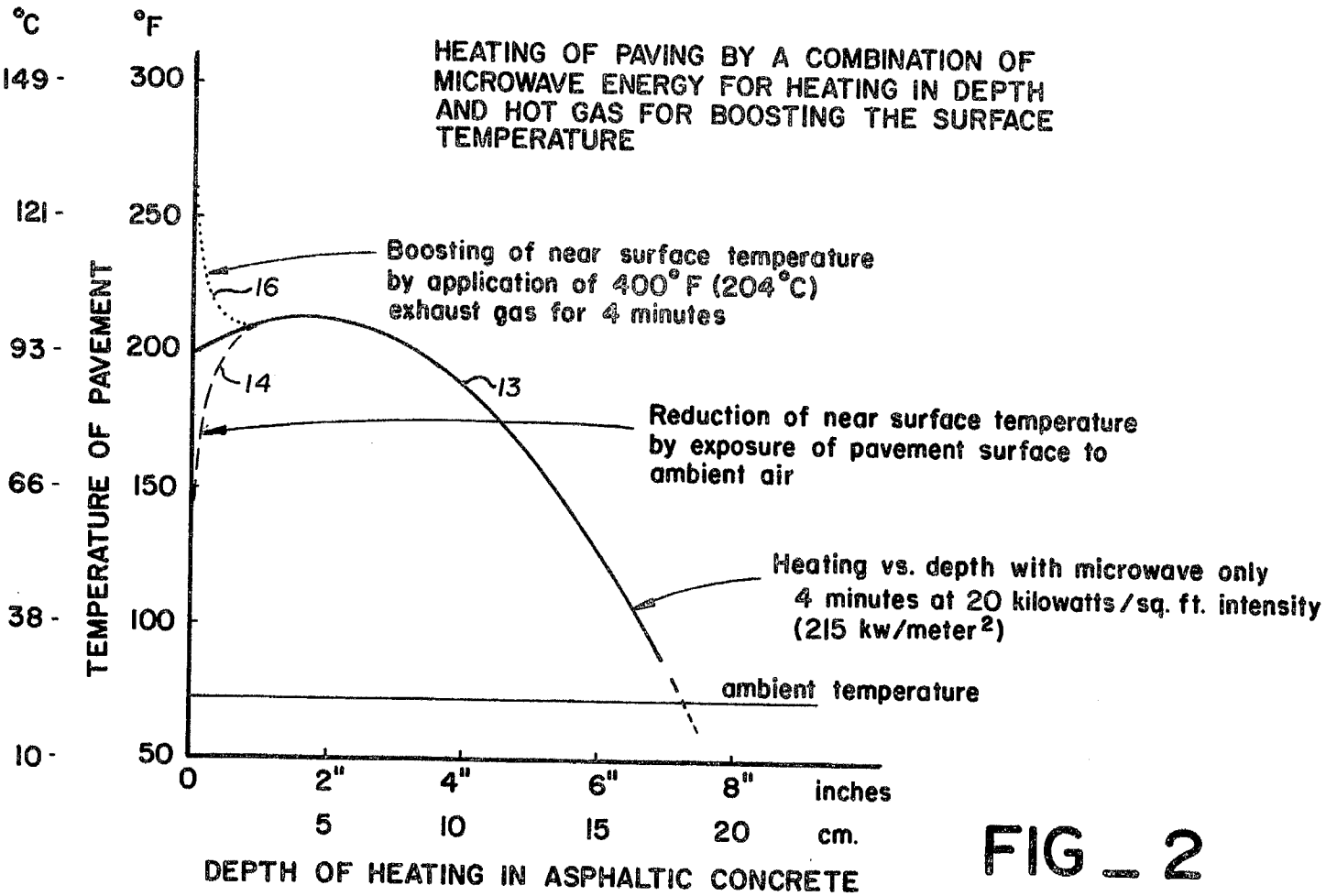
FIG. 2 is a graph illustrating measured temperatures at different depths within a typical sample of asphaltic concrete following a microwave irradiation of the sample and also illustrating the effects of an embodiment of the present invention in altering the temperature distribution produced by microwave irradiation alone.

Solid curve 13 of FIG. 2 depicts the temperature gradient produced in a sample of asphaltic concrete by microwave irradiation alone at an intensity of 20 kilowatts per square foot (215 kw/meter 2) for a period of four minutes. The maximum pavement temperature of 225° F. (107° C.) occurs at a depth of about two inches (5 cm) rather than at the surface and this decreases to about 200° F. (93° C.) at the surface. The solid line curve 13 of FIG. 2 is not, however, necessarily indicative of the full magnitude of the inverted temperature gradient near the pavement surface under many actual conditions as it does not take into account cooling effects which may occur. If the pavement surface is exposed to ambient air, the inverted temperature gradient is more pronounced as shown by dash line 14 in FIG. 2, the surface temperature being reduced to 150° F. (66° C.) in this instance. The extent of this cooling induced amplification of the inverted temperature gradient is variable as it is dependent on factors such as weather conditions.

Dotted curve 16 in FIG. 2 illustrates the counteraction and reversal of the inverted temperature gradient in the upper region of the pavement resulting from application of hot gas at 400° F. (204° C.) to the surface of the pavement during an otherwise similar irradiation with microwave energy. The extent to which the supplementary application of thermal energy to the surface counteracts or reverses the inverted temperature gradient portion of curve 13 may be adjusted by controlling the temperature of the gas which is directed against the surface. Where old asphaltic concrete pavement is to be heated, somewhat greater heating of the immediate surface of the pavement, for example to 250° F. (121° C.) as depicted in FIG. 2, is often desirable because of the presence of a crust at the surface produced by the evaporation of the more volatile components of the asphalt binder over a long period of time. Somewhat greater heating of the surface region of the pavement may also be desirable to compensate for expected cooling which may occur after the heating operations are stopped, but prior to completion of repairs or other processing of the heated pavement.

Figure 3:
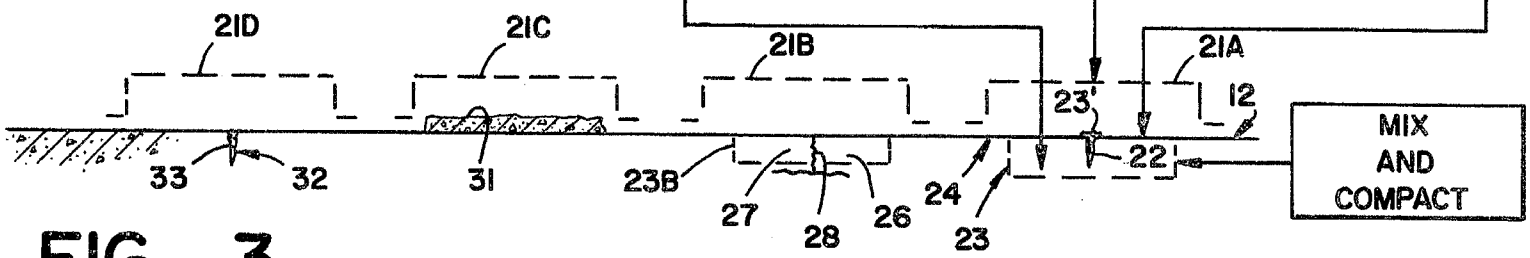
FIG. 3 is a diagrammatic illustration of additional steps which may be employed in the practice of the method of FIG. 1.

While other heating means may be used to apply the supplemental thermal energy to the surface of the pavement in conjunction with the microwave heating, it is particularly advantageous from the standpoint of efficient use of energy to use thermal energy derived from a source which is typically present in the practice of the method but which otherwise uselessly dissipates such heat. Referring now to FIG. 3, microwave sources 15 such as magnetron tubes or the like, are energized with electrical energy and, at least in many instances, it is necessary to have motor-generator means at the site of the pavement heating operations, as electrical utility lines may not be available or readily adaptable for supplying the electrical power. As depicted diagrammatically in FIG. 3, such a motor generator set typically includes one or more electrical generators 18 driven by one or more motors 19 which are fuel-consuming engines producing hot exhaust gases. Although the precise factor varies somewhat for different specific types of engine, such as diesel engines, gasoline engines, turbine engines and the like, fuel-consuming engines in general typically exhaust and waste around 70% of the energy content of the consumed fuel, most of it in the form of heat in the exhaust gas. Substantial energy efficiencies may be realized in the practice of the present method by using thermal energy derived from the exhaust gas of the motor-generator to perform the surface heating step of the above described method. This may be accomplished by transmitting some or all of the exhaust gases of motor 19 to the surface 12 of the pavement within the microwave containment region 21. In instances where governmental regulations or other considerations may restrict the direct release of the motor exhaust gas at the pavement surface 12 for pollution control reasons or other causes, a heat exchanger may be used to transfer thermal energy from the exhaust gas to a flow of heated air which is directed to the pavement surface. Gas temperature may be reduced by diluting the exhaust gas flow with ambient air or by providing for a controlled degree of cooling of the gas flow between the motor to the actual pavement surface.

The heating method described above may variously be used to heat existing pavement prior to repairs, to heat previously unpaved surfaces to assure good bonding with paving material about to be applied, to heat paved surfaces to assure good bonding of an overlayer of new pavement about to be applied or to facilitate the curing of thermosetting pavement or pavement patching materials. While, in practice, operations at a given time at any single strip of surface 12 are likely to be of the same particular type, for convenience of illustration FIG. 3 depicts a series of different operations of these various types at a series of different locations along the surface 12.

At microwave and hot gas containment region 21A, FIG. 3 depicts use of the pavement heating method in conjunction with the repair of a localized deteriorated area of asphalt concrete or other thermoplastic pavement, which area may have one or more cracks 22, potholes or the like. Simultaneous application of microwave and hot gas to the pavement surface below containment region 21A as described above rapidly decomposes asphaltic concrete to a depth typically of the order of 10 to 12 centimeters. By decomposition it is meant that the pavement is heated sufficiently to cause the asphalt binder to become liquid or semi-liquid so that the pavement constituents may be remixed and recompacted, after termination of the heating step, to provide a reconditioned, smooth surfaced, crack-free repaired area. Heating is typically continued sufficiently long to bring the areas of the asphaltic concrete which are to be remixed to temperatures ranging from about 205° F. (96° C. ) at the bottom of the zone to be remixed to around 300° F. (150° C.) at the surface. If the cracks 22, potholes or other declivities are sufficiently extensive, the addition of supplementary paving materials 23 may be desirable in order to provide a final surface which is continuous with the adjacent untreated pavement. A filling of such paving materials, which may be in initially cold condition, may be provided in cracks 22 and the like prior to the heating steps and preferably after cleaning the cracks. Alternately, a thin layer of additional paving material may be spread out on the surface of the area to be treated prior to the heating steps. The added material is then heated along with the pre-existing pavement and becomes mixed in during the subsequent mixing of the decomposed area of pavement. In other instances, the added paving material may be hot mix applied to the surface after termination of the heating steps, but prior to the mixing and compacting steps.

While the heating steps heat a specific predetermined area of the pavement which is then remixed and recompacted, there is not an abrupt boundary between the decomposed area and the adjacent undecomposed portions of the pavement. A lateral temperature gradient is present adjacent the boundary of the predetermined area. This results in an extremely strong bonding of the reconditioned, remixed and recompacted area with the adjacent unremixed portions of the pavement, a characteristic notably absent from most prior localized pavement patching processes. I have found that this strong bonding of the reconditioned area to adjacent untreated areas of the pavement can be further enhanced by confining the remixing step to the central portion 23 of the heated area of pavement below the microwave containment region 21A, the marginal portions 24 of the heated and decomposed area being left unmixed but being compacted along with the remixed central area 23. This assures that the remixed pavement is recompacted into adjacent material that is at bonding temperatures at all portions of the margin of the remixed region.

Following repair of the predetermined deteriorated area of pavement below microwave containment region 21A, similar repair steps may be performed at other locations along the paved surface 12 which may be in need of such repairs. Repairs may be performed at a series of separate small areas of the paved surface 12 or the operations may be performed on a continuous basis by traveling the microwave and hot gas containment region 21A continuously along the surface 12, utilizing equipment to be hereinafter described or utilizing equipment of the form disclosed in my above-identified copending application Ser. No. 756,365.

Figure 4A:
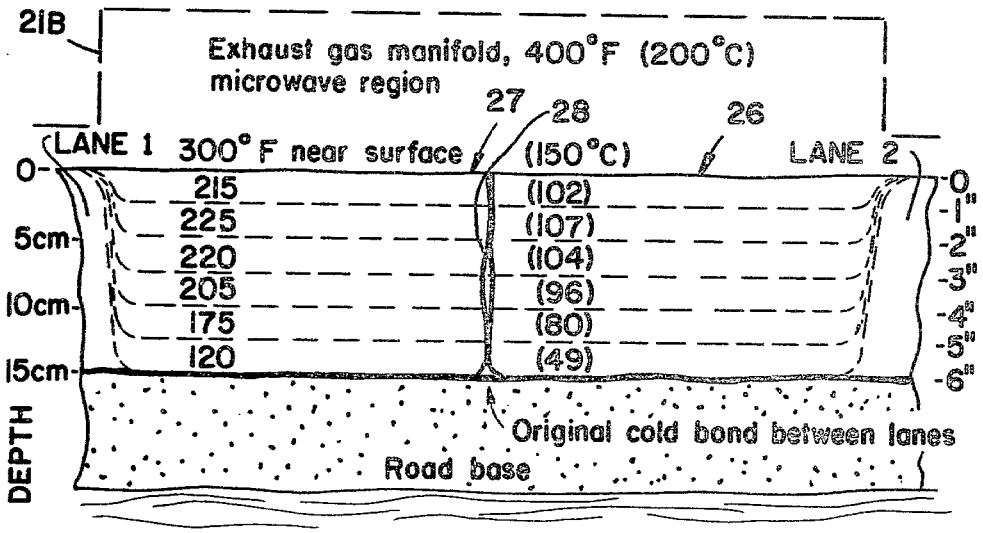

The process of decomposing a predetermined area of pavement followed by remixing of only a central portion of the decomposed pavement and by subsequent compaction of the whole as described above, is particularly advantageous in removing a source of pavement deterioration which has been a serious problem in connection with roadway maintenance and which results essentially from the methods originally used to construct such roadways. As illustrated in FIG. 3 at a second microwave and hot gas containment region 21B, it has been a common practice to form asphalt concrete roadways or the like of adjacent parallel strips of pavement 26 and 27 that were laid at different times with the result that one strip had cooled at least to some extent prior to the formation of the other strip. Consequently, the juncture 28 between the two strips 26 and 27 tends to be very weakly bonded if at all. Over a period of time cracking is likely to occur along the juncture 28 and the crack, once formed, may rapidly enlarge from a variety of causes such as from uneven vehicle pressures and freezing and thawing of moisture which seeps into the cracks. The method hereinbefore described in connection with the portion of the pavement 12 below the first microwave and gas containment region 21A may be utilized to remove the crack and to inhibit repeated deterioration from similar causes. FIG. 4A depicts in more detail the use of the method to eliminate the above-described crack or cold bond 28 between the adjoining strips of pavement 26 and 27. More specifically, FIG. 4A depicts isotherms or lines of similar temperature within a typical asphaltic concrete pavement of 15 centimeters depth following combined microwave and hot gas heating of a selected rectangular area which straddles the cold bond 28. The temperature distribution in the heated portions of the adjoining pavement strips 26 and 27 as depicted in FIG. 4A results from a four minute microwave irradiation at an intensity of 215 kilowatts per square meter accompanied by the application of diesel engine exhaust gas at 200° C. to the surface of the pavement. A temperature gradient is produced below the microwave and hot gas containment region 21B ranging from 150° C. at the surface to 49° C. at the base of the pavement, which is of 15 centimeters depth in this example.

Figure 4B:
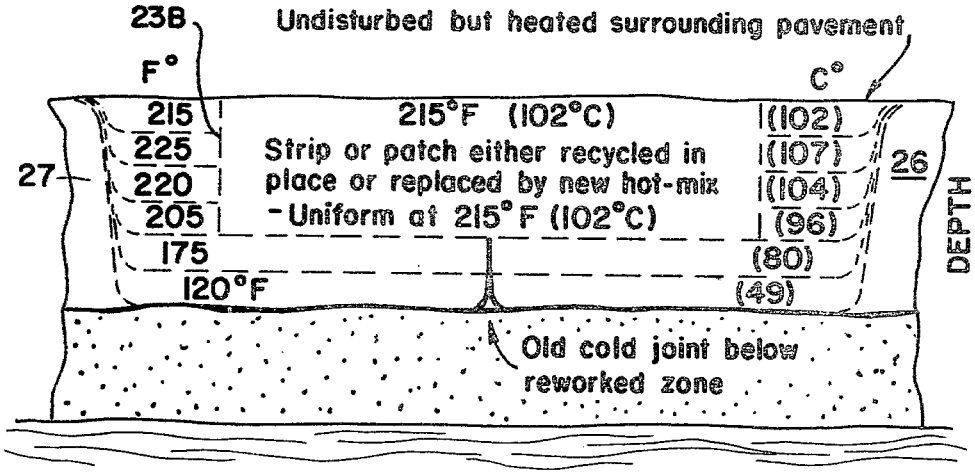
FIG. 4B is a diagrammatic cross-section of the same section of asphaltic concrete pavement following additional operations in accordance with one embodiment of the invention and illustrating a modified distribution of temperatures following the additional operations.

Referring now to FIG. 4B, following removal of the microwave and hot gas containment region 21B, a central portion 23B of the decomposed pavement is remixed in place to a depth of about 10 centimeters in this example, leaving an unmixed margin around the remixed area of at least several centimeters extent. As may be seen in FIG. 4B, one effect of the remixing, aside from eliminating the cold bond and any cracking which may exist therealong, is to create a uniform temperature throughout the remixed region 23B spanning the two pavement strips. As an alternate procedure, instead of remixing of the old pavement constituents within the central portion 23B, the decomposed old materials may be removed from that region and replaced by new hot mix which may be of about the same temperature, specifically about 102° C., as the remixed original materials discussed above. In either case, the temperature of the remixed or replacement hot mix material is everywhere close to the temperature of the intact surrounding old pavement material and the temperatures are in the optimum range for compaction. Thus, upon compaction, preferably using a vibrating compactor, the bond between the remixed or new material and the intact old material at all points around the region 23B becomes a hot bond in which aggregate particles are driven into a meshing or interlocking physical system which upon cooling becomes resistant to mechanical flexing and resistant to the intrusion of moisture.

Referring again to FIG. 3, another microwave and hot gas containment region 21C is shown over another section of the pavement 12 which in this instance is to be repaired by the application of an overlayer of asphaltic concrete material 31. The additional paving material 31, which may initially be cold if desired, may simply be spread out over the area of the pavement 12 to be overlaid and then heated within containment region 21C using the steps previously described. Following heating of the pavement material 31 accompanied by heating of the underlying pavement 12 to facilitate good bonding, the materials 31 may be mixed and compacted to form the desired overlayer of new pavement. In other instances, the overlayer 31 which is heated in place on the pavement 12 may consist simply of rock aggregate with hot liquid asphalt being added in after removal of the microwave and hot gas containment region 21C, which step may be followed by mixing in place and compaction against the surface. The overlayer of material 31 may also be cold mix of one of the types in which heating promotes curing of the mix. The layer of materials 31 for the overlayer may also consist of chunks of old asphaltic concrete recovered from a dump site or from a roadway or the like which is being removed. Following heating of such an overlayer of old asphaltic concrete chunks within the containment region 21C in accordance with the method, the decomposed material may be remixed in place on the surface 12 and then compacted to form the desired overlayer.

As illustrated at still another microwave and hot gas containment region 21D in FIG. 3, the pavement heating method is not confined to operations with asphaltic concrete or other thermoplastic paving, but may also be used for the repair of Portland cement concrete pavements including operations using patching or crack filler materials which are thermosetting rather than thermoplastic. For example, a crack 32 or other declivity in such a pavement may be cleaned and filled with a polymer patching compound 33 of known composition and then both the adjoining regions of the pavement and the patching compound itself may be heated in accordance with the method previously described to facilitate curing or polymerization of the compound and to assure strong bonding of the hardened compound to the adjacent pavement.

It should be understood that the above-described examples of paving and pavement repair procedures are not exhaustive of the usages of the method of the invention. Similarly, while in the examples of the method described above, a fixed predetermined localized area of the pavement is heated at any specific time, it is also possible to perform the pavement heating operations continuously while traveling along the pavement surface 12.

Figure 5A:
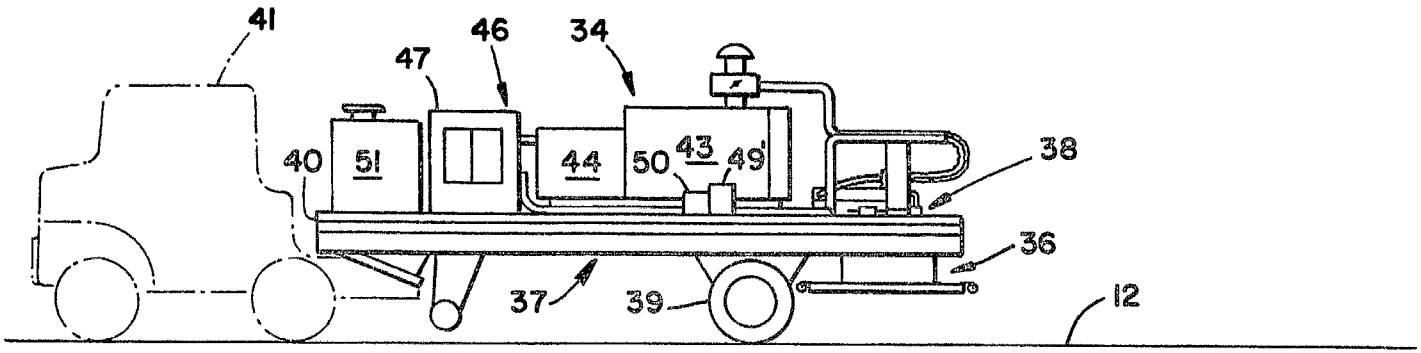
FIG. 5A is a side elevation view of pavement heating apparatus including an energy applicator shown in retracted condition to facilitate movement of the apparatus from one work site to another.
Figure 5B:
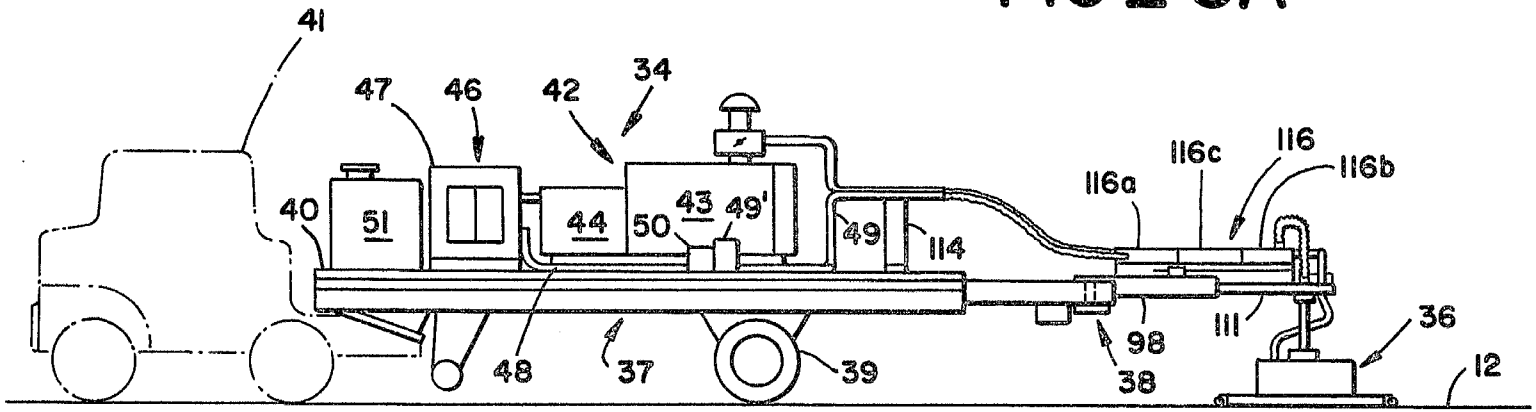
FIG. 5B is also a side elevation view of the pavement heating apparatus of FIG. 5A with the energy applicator means positioned to heat a selected area of pavement.

Portions of the method described above, such as the mixing and compaction steps, may be performed using known commercially available equipmemt for such purposes. Considering now energy applicator means suitable for establishing a containment region for both microwave energy and hot gas over a surface to be heated, my above-identified copending application Ser. No. 756,365 discloses examples of apparatus which may be used for this purpose, and in some cases for the mixing and compaction steps as well, but such apparatus is primarily adapted for the large scale reprocessing of lengthy continuous strips of pavement while continuously traveling along the pavement. Referring now to FIGS. 5A and 5B, pavement heating apparatus 34 is depicted, which is specifically designed to facilitate the practice of the above-described method in instances where relatively small predetermined localized deteriorated areas of a paved surface 12 require repair, the apparatus 34 being in general less complex and less costly than most of the self-propelled traveling systems described in the above-identified copending application.

The pavement heating apparatus 34 includes an energy applicator 36, to be hereinafter described in more detail, which in operation is positioned over the predetermined area of the paved surface 12 which is to be heated as depicted in FIG. 5B in particular. While the energy applicator 36 may in some cases be adapted to be manually positioned and manually moved to successive areas of the pavement to be heated, it is preferable that it be attached to a movable support vehicle 37 by support linkage 38 which enables a limited degree of repositioning of the energy applicator at different closely located areas of the pavement 12 without necessarily requiring movement of the vehicle itself.

While energy applicator 36 may be supported on a self-propelled vehicle where the cost and complication are economically justified, it is more practical in many cases that the support vehicle 37 be a towable trailer. In this example, the support vehicle 37 is a trailer of the form having a bed or platform 40 riding on rear road wheels 39 and which couples at the forward end to a highway truck tractor unit 41 of known form. If the tractor unit 41 is to be temporarily removed during operations, supplementary support means, such as additional road wheels or extendable jacks, may be provided to support the forward end of the trailer at such times.

In addition to the energy applicator 36 and support linkage 38, the support vehicle 37 carries a motor generator set 42 of the known form having a fuel consuming motor 43 driving an electrical generator 44. The motor 43 may, for example, be of the diesel variety although other types of fuel burning engine may also be employed. Additional motor-generator sets may also be provided where the energy applicator 36 requires more electrical power than is provided by a single set.

Generator 44 supplies electrical energy to microwave source power supplies 46, which may be of known construction, and which are situated in a cabinet 47 on platform 40. The insulated output cable 48 from power supplies 46 extends backward along platform 40 to connect with the energy applicator 36 in a manner which will hereinafter be described in more detail.

One or more tanks or receptacles for carrying supplies of pavement conditioner liquid, heated supplementary asphalt, supplementary rock aggregate or other materials may be carried on the support vehicle 38, a conditioner liquid tank 51 being provided in the present example. A pump 49' for supplying coolant to the microwave sources together with an electrical drive motor 50 are also situated on platform 40.

Figure 6:
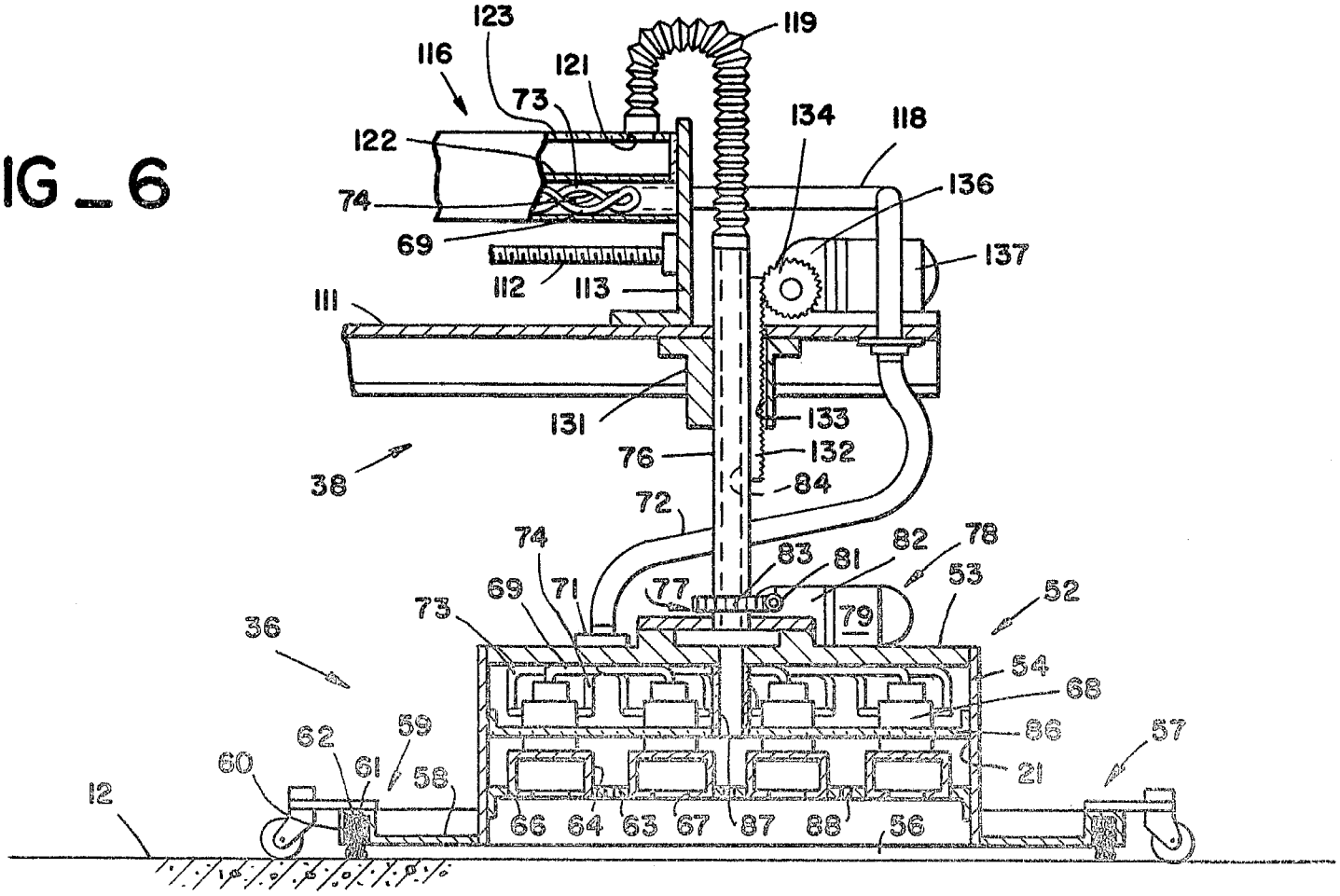
FIG. 6 is an elevation section view of an energy applicator for heating pavement which is a component of the apparatus of FIGS. 5A and 5B, the view being taken along line VI—VI of FIG. 7.

Referring now to FIG. 6, the energy applicator 36 is of rectangular configuration in this example and has an inverted box-like housing 52 with a top member 53 and downwardly extending side wall members 54, all of which are formed of electrically conductive material to block the escape of microwave energy from the containment region 21 in upward and outward directions. To facilitate positioning and movement of the energy applicator 36, caster wheels 55 are disposed at the four corners of housing 52 and maintain the housing in a slightly spaced-apart relationship from the pavement surface 12. This results in a small gap 56 between the pavement and the lower edges of the housing side walls 54. To suppress outward propagation of microwave energy through the gap 56, trapping means 57 are provided at the outer side of the lower edges of housing side wall members 54. Trapping means 57 in this example include horizontal panels 58 of electrically conductive material, which extend outward from the lower edges of the side walls 54 of the housing in slightly spaced-apart relationship from the pavement surface 12, to form what is termed a "gap trap." The electrically conductive panels 58 function to suppress broadcasting of microwave energy outwardly through gap 56 since it is a characteristic of microwave energy that in propagating through space, the energy does not flow in a coherent manner, but instead continually tends to disperse relative to the nominal direction of propagation. Consequently, as energy propagates outwardly within the gap 56 between panels 58 and pavement 12, a portion of such energy travels downwardly into the pavement 12 where it is absorbed. Another portion of such energy, which would otherwise propagate upwardly, is reflected by the conductive panels 58 and redirected downwardly into the pavement where it is also absorbed. Consequently, there is a progressive attenuation of microwave energy intensity in the outward direction along the gap between panels 58 and the pavement 12. By forming the panels 58 to be of sufficient lateral extent, typically at least several centimeters, the intensity of microwave energy at the outer edges of the panels may be reduced to a negligible value.

Suppression of the release of microwave energy, other than downwardly into the absorbent pavement 12, is further assured by supplementing the gap trap defined by panels 58 with another and different form of microwave energy trap which in this example is of a type termed a "chain trap" 59. The outer portion of each panel 58 is angled to form an inverted channel 61 of conductive material which extends all the way around the housing 52 at the outer portions of the panels. The channel 61 is filled with a mass of short portions of flexible metallic chain 62 which are of sufficient length to extend downward from the top of the channel to contact and drag along the surface of the pavement 12. The chain trap 59 functions to block the outward propagation of microwave energy through gap 56 since such energy cannot pass through a mass of electrically conductive material in which all interstices or open passages have transverse dimensions substantially smaller than the wavelength of the microwave energy.

Other forms of microwave trap of the several types disclosed in my above-identified copending application Ser. No. 756,365 may also be used in place of or in conjunction with the gap trap and chain trap of this example.

To provide for the downward release of microwave energy into the pavement 12 underlying the containment region 21, a horizontal panel 63 is secured within the housing to support one or more waveguides 64. Four parallel horizontally extending waveguides 64 are provided in this example and each is mounted in a conforming slot 66 in panel 63 so that the lower wall of the waveguide faces the pavement 12. Waveguides 64 in this example are of the leaky waveguide form disclosed in my U.S. Pat. No. 3,263,052 and thus each such waveguide has a series of microwave emission slits 67 spaced apart along the underside of the waveguide to provide for a distributed downward release of microwave energy into the area of pavement over which the housing 52 is disposed.

Waveguides 64 are excited by suitable microwave source means which in this example includes a separate magnetron tube 68 situated at one end of each waveguide 64 and supported thereon within housing 52. Electrical connections between each magnetron tube 68 and the previously described microwave power supplies 47 of FIG. 5A are provided for by electrical conductors 69 which extend from each magnetron tube to a connector 71 on housing top member 53 to which a flexible multi-conductor cable 72 is connected. Liquid coolant supply conduits 73 from pump 49 of FIG. 5A and coolant return conduits 74 for the magnetron tubes 68 also extend from each such tube into cable 72 through connector 71.

Referring again to FIG. 6 in particular, a vertical support shaft 76 extends upward from the center of housing top member 53 and is coupled to the housing 52 through a swivel joint 77 which enables the housing to be rotated relative to the support shaft for purposes to be hereinafter described. While such rotation of the energy applicator 36 may be accomplished manually, it is advantageous to provide powered positioning means 78 which, in this example, includes a reversible electrical motor 79 secured to top member 53 and driving a worm gear 81 through a speed reducing gear box 82. Worm gear 81 engages a gear 83 secured to shaft 76 in coaxial relationship thereon so that by operation of the motor 79 the energy applicator 36 may be swiveled in either direction relative to the shaft.

While a separate flexible conduit may be used for the purpose, hot gas is transmitted to the containment region 21 in this example through an axial passage 84 in shaft 76. Another horizontal panel 86, formed of thermally insulative material in this case, is disposed within housing 52 above waveguides 64 and below the upper portions of the magnetron tubes 68 which extend through the panel 86. A vertically extending thermally insulated conduit 87 transmits gas from the lower end of shaft passage 84 to the region below panel 86. The lower panel 63 is provided with small openings 88 situated between the waveguides 64 through which the gas is transmitted downward and directed to the surface of the underlying pavement 12.

The support linkage 38 through which the energy applicator 36 is coupled to vehicle 37 enables the applicator to be lifted and retracted to a position just below the back end of trailer platform 40, as depicted in FIG. 5A, when the paving apparatus is to be traveled between different work sites or to be moved for other purposes, and as indicated in FIG. 5B enables the applicator to be extended backwardly from the support vehicle a selectable distance and to be moved sidewardly in either direction relative to the vehicle so that different localized areas of the pavement 12 in a given vicinity may be heated without necessarily moving the vehicle itself. This capability also allows the applicator 36 to be placed at locations which would otherwise require difficult manuevering of the support vehicle.

Figures 7, 8:
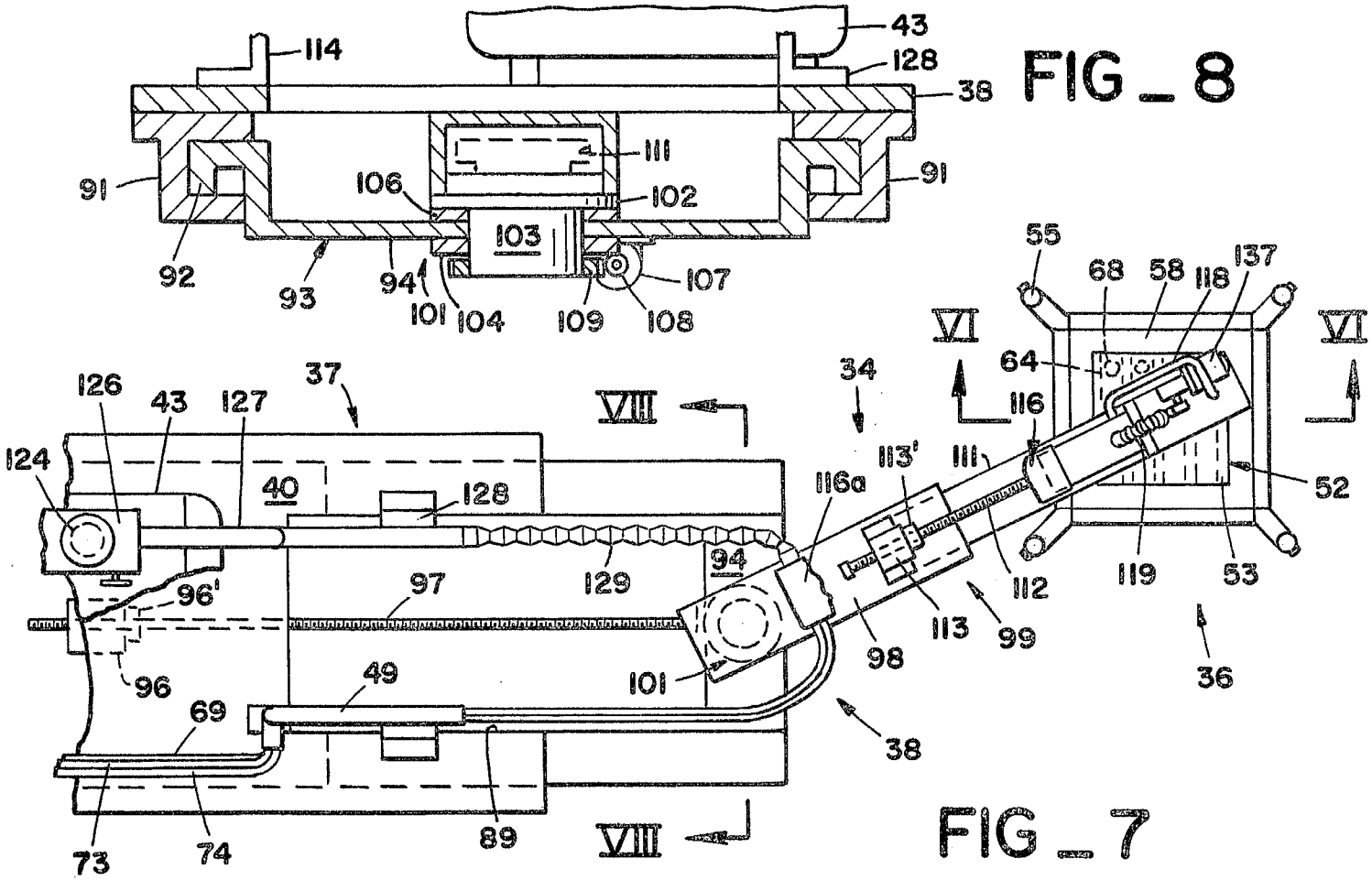
FIG. 7 is a plan view of a rear portion of the pavement heating apparatus of FIG. 5B.
FIG. 8 is a cross-section view of the apparatus of FIG. 7 taken along line VIII—VIII thereof.

Referring now to FIGS. 7 and 8 in conjunction, the back end of the platform 40 of the support vehicle 37 may have a rectangular recess 89 for receiving energy applicator 36 when it is retracted into the carrying position depicted in FIG. 5A. Referring again to FIGS. 7 and 8 in conjunction, inwardly opening channel members 91 are secured along the underside of each lateral edge of the vehicle platform 40 to receive and support opposite side members 92 of a sub-frame 93 which is slidable along the channel members in a forward and backward direction. A cross-member 94 extends between the back ends of the side members 92 of the sub-frame at a slightly lower elevation than the side members. To travel the sub-frame 93 in forward and backward directions relative to platform 38, reversible electrical motor 96 is secured to the underside of platform 40 and has a rotary output member 96' which engages with a threaded lead screw 97. The back end of lead screw 97 is secured to the center of sub-frame cross-member 94 so that operation of the motor in one direction draws the sub-frame 93 forward while reversed operation of the motor extends the sub-frame outward from platform 40. Other travel means such as chain drives, extensible and contractible fluid actuators or the like may be substituted for the motor 96 and lead screw 97.

A first member 98 of a telescoping boom assembly 99 has one end secured to the center of sub-frame cross-member 94 by a pivot coupling 101 which enables the boom assembly to be swung horizontally in order to shift the energy applicator 36 sidewardly in either direction. First boom member 98 which is of hollow, rectangular cross-section, is secured to a flange 102 at the upper end of a pivot shaft 103. Pivot shaft 103 extends downward through an opening in the center of sub-frame cross-member 94 and is held in place by an annular coaxial retainer ring 104 secured to the shaft immediately below the cross-member, a bearing 106 preferably being situated between the flange 102 and the upper surface of the cross-member. To facilitate pivoting of the boom assembly 99, another reversible electrical motor 107 is secured to the underside of cross-member 94 and has an output worm gear 108 which engages a gear 109 secured to the lower end of shaft 103 in coaxial relationship thereon.

The second member 111 of the telescoping boom assembly is an inverted rectangular channel member conforming with the hollow interior of first member 98 into which it extends and in which it is slidable to retract and extend the energy applicator 36 relative to sub-frame 94. To extend and retract the boom assembly 99, another lead screw 112 has an end secured to a bracket 113, shown in FIG. 6, which is secured to the top of the second boom member 111. Referring again to FIG. 7, lead screw 112 is engaged by an internally threaded output element 113' of another reversible electrical motor 113, which is itself secured to the top of the first boom member 98.

Thus, starting from the carrying position at which the energy applicator 36 is situated within recess 89 of platform 40, the energy applicator may be extended outward from the support vehicle by operation of the motor 113 and may be extended still further outward by operation of motor 96. At any selected degree of extension, the applicator 36 may be shifted to one side or the other of the center line of the support vehicle by operation of electrical motor 107, shown in FIG. 8. In order to maintain the energy applicator 36 in a desired angular relationship to the underlying pavement when the telescoping boom 99 is pivoted to one side or the other, the swivel drive motor 79 of FIG. 6 may be operated. In reconditioning localized areas of a roadway, for example, it is usually desirable that the sides of a rectangular patched area be either parallel or transverse to the direction of vehicle travel on the pavement, and the ability to swivel the applicator relative to the boom 99 as the boom is pivoted enables this relationship to be maintained.

Referring again to FIG. 7, the electrical cables 69 which couple the magnetron tubes in the applicator 36 with the power supplies on platform 40 and the conduits 73 and 74 which transmit coolant to and from the magnetron tubes in the applicator 36 extend into a rigid angled support pipe 49 which is best seen in FIG. 5B and which has a back end supported at an elevated location above the platform 40 by a bracket 114. Referring again to FIG. 7, the flexible electrical cables 69 and fluid conduits 73 and 74 extend from the back end of pipe into a telescoping conduit housing 116 which has a forward section **116*a* secured to the top of boom member 98 and which has an outer end member 116*b* secured to second member 111 of the boom assembly and which also has an intermediate section 116*c* to enable the conduit housing 116** to contract and extend as the telescoping boom assembly is itself contracted and extended.

Referring again to FIG. 6, the electrical conductors 69 and coolant conduits 73 and 74 are loosely coiled within the telescoping conduit housing 116 to accomodate to the extension and contraction of the housing. Conductors 69 and conduits 73 and 74 emerge from the back end of housing 116 into another rigid protective angled pipe 118 which is secured to the outer end of boom member 111. From pipe 118, the conductors 69 and conduits 73 and 74 enter the previously described flexible multi-conductor cable 72 which is coupled to the energy applicator 36 at connector 71. Cable 72 is loosely spiraled between the lower end of pipe 118 and the top of the energy applicator 36 to accommodate to the previously described swiveling motion of the applicator housing relative to the shaft 76 and boom 111 and to also accomodate to vertical lifting and lowering of the applicator relative to the boom 111.

To transmit hot gas into the upper end of applicator support shaft passage 84 for delivery to the containment region 21 as previously described, a flexible, extensible and compressible hose 119, formed of pleated thermally insulative material, is connected between the upper end of shaft 76 and an opening 121 at the top of the back end of telescoping conduit housing 116. The upper portion of each telescoping section of housing 116 is closed from the lower portion of the housing by a panel 122 of thermal insulation material and additional thermal insulation 123 is provided on the interior walls of the upper portion of the housing to provide an insulated path for transmitting hot gas to opening 121 and hose 119. Referring again to FIG. 7, hot engine exhaust gases from the exhaust conduit 124 of the motor generator set motor 43 are intercepted at a valve 126 which diverts a selectable portion of the motor exhaust gas into a rigid thermally insulated pipe 127. Pipe 127 has a back end supported at an elevation corresponding to that of the electrical conductor and fluid conduit pipe by another bracket 128 extending upwardly from platform 38. Another section 129 of flexible, expansible and contractible pleated conduit of thermally insulative material is connected between the back end of pipe 127 and the upper portion of housing member **116*a* to transmit hot engine exhaust gas to the previously described insulated flow path within the telescoping housing 116**.

Referring again to FIG. 6, the vertical support shaft 76 for the energy applicator 36 extends through a guide sleeve 131 secured to the back portion of telescoping boom member 111. To enable selective raising and lowering of the applicator 36 relative to pavement surface 12, a linear gear rack 132 is secured along the portion of the shaft which extends through sleeve 131, a slot 133 being provided within the sleeve to accomodate to the presence of the rack. Rack 132 is engaged by an output gear 134 of a speed reduction gear box 136 driven by another reversible electrical motor 137, the motor being secured to the outer end of boom member 111. Thus, operation of motor 137 in one direction controllably raises the energy applicator 36 while reversed operation of the motor lowers the applicator. Rack 132, by extending within slot 133 of sleeve 131, prevents rotational motion of the applicator support shaft 76, enabling the angular orientation of the applicator to be precisely controlled by operation of swivel drive motor 79.

Other forms of support linkage means enabling similar positioning of the energy applicator 36 may be substituted for the specific support means 38 described above. Similarly, while the several extendible and contractible elements and pivoting or swiveling elements of the applicator support and positioning linkage 38 described above are provided with motors for facilitating and controlling the several motions, one or more of the motors may be dispensed with and the elements at each such point may be traveled or turned by hand except where weight, friction or temperature conditions or the like may prevent such operations.

INDUSTRIAL APPLICABILITY

In operation, the pavement heating apparatus 34 may be used in the performance of any of the methods hereinbefore described and for other purposes as well which require the heating of pavement, or heating of paving materials situated on pavement or in cracks in the pavement, or the heating of a surface in preparation for paving operations. Support vehicle 37 is moved to a location adjacent to the area or areas to be heated. Energy applicator 36 may then be extended from the back end of the vehicle 37 an appropriate amount and swung to one side or other of the center line of the vehicle if necessary, and then lowered to locate the applicator over the area of pavement which is to be heated, by operation of the several electrical motors 79, 96, 107, 113 and 136. Microwave sources 68 are then activated to direct microwave energy downwardly into the underlying area of pavement, while valve 126 is opened to direct hot motor exhaust gas to the surface of the same area.

After the desired degree of in-depth heating of the underlying area has been accomplished, the energy applicator 36 may be moved aside, and lifted if necessary by operation of an appropriate combination of the electrical motors, depending on the direction in which it is desired to move the applicator. Remixing and recompacting of the heated area of the pavement, repair or patching or other operations as hereinbefore described may then be performed at the heated area.

If additional pavement areas in the immediate vicinity require heating, the several electrical motors of the support linkage 38 may be actuated as necessary to bring the applicator over each such area in turn and the heating steps are then repeated at each such area. When all pavement areas to be treated that are reachable solely by manipulation of the support linkage 38 have been heated, support vehicle 37 may itself be moved to another vicinity where heating of additional areas of pavement may be required.

While the pavement heating apparatus 34 is designed to facilitate the heating of small, often spaced-apart areas of pavement with the energy applicator 36 being temporarily held stationary at each such location to be heated, the apparatus may also be employed to heat pavement on a continuous process basis by continually moving the energy applicator 36 along the strip of pavement while in operation. Castor wheels 55 facilitate such travel of the applicator while in operation. This mode of operation is made practical by the microwave energy trapping means 59 which enable such movement by allowing operation of the applicator while it is spaced slightly from the underlying pavement to avoid abrasion. The movement of the energy applicator 36 for such purposes may be accomplished solely by operation of one or more of the positional drive motors 79, 96, 107, 113 and 136, where the area to be treated is of limited extent, or the motion of the applicator may be produced by traveling the support vehicle 37 itself slowly along a strip of pavement, or a combination of both modes of applicator movement may be used.

Other aspects, objects and advantages of this invention can be obtained from a study of the drawings, the disclosure and the appended claims.

What is claimed is:

1. In a method for heating pavement wherein microwave energy produced by a first source of heating energy is directed downward into said pavement to generate heat internally and instantaneously within the subsurface interior region of said pavement, and wherein said microwave energy heats a deeper region of said pavement more strongly than the uppermost region thereof thereby tending to produce an inverted temperature gradient in said uppermost region the further steps comprising operating a fuel consuming motor to drive a generator to produce electrical energy for conversion to said microwave energy, and counteracting said inverted temperature gradient while reducing nonproductive energy dissipation by transmitting thermal energy from the exhaust gases of said motor to the surface of said pavement to supplement the microwave heating of said uppermost region of said pavement.

2. The method of claim 1 further including the steps of establishing a hot gas confinement region adjacent said surface of said pavement and transmitting said thermal energy from said exhaust gases of said motor to said confinement region.

3. The method of claim 1 wherein said step of transmitting thermal energy to said surface of said pavement is performed by transmitting at least a portion of said exhaust gases of said motor to said surface of said pavement.

4. In a method for heating pavement wherein microwave energy is directed downward into said pavement to generate heat within said pavement including within the subsurface region thereof, the further step comprising applying thermal energy to the surface of said pavement to supplement the microwave heating of the uppermost region thereof including applying said thermal energy to said surface of said pavement in sufficient amounts to heat the uppermost region of said pavement to a higher temperature than said microwave energy heats said subsurface region thereof.

5. In a method for heating thermoplastic pavement wherein microwave energy produced by a first source of heating energy is directed downward into said pavement to generate heat internally within the subsurface region of said pavement, the steps comprising:

applying thermal energy produced by a second source of heating energy to the surface of said pavement to supplement the microwave heating of the uppermost region of said subsurface region, confining said microwave heating of said pavement and said supplemental heating of the surface thereof to a predetermined fixed area of said pavement which is to be repaired, decomposing the pavement within said predetermined area by said microwave heating and said supplemental heating and then remixing and recompacting a portion of the decomposed pavement within said predetermined area, wherein said remixing is limited to portions of said decomposed pavement situated away from the border portions of said predetermined area to provide a heated but unmixed zone of pavement between the mixed portions and nearby unheated pavement whereby a temperature distribution is provided that enhances bonding of the remixed material to the pavement.

6. In a method for heating pavement wherein microwave energy produced by a first source of heating energy is directed downward into said pavement to generate heat internally within the subsurface region of said pavement, the further step comprising applying thermal energy produced by a second source of heating energy to the surface of said pavement to supplement the microwave heating of the uppermost portion of said subsurface region, confining said microwave heating of said pavement and said supplemental heating of the surface thereof to a predetermined fixed area of said pavement which is to be repaired, removing at least a portion of said decomposed pavement from a central region of said predetermined area following said microwave heating and supplemental heating thereof while leaving the pavement of the marginal regions of said area in place whereby said central region is bounded by pavement having a temperature distribution which enhances bonding of additional hot pavement mix to said pavement, replacing the removed portions of said decomposed pavement with additional hot pavement mix, and compacting both the old pavement of said marginal regions and the additional hot pavement mix within said predetermined area.

7. In a method for heating pavement wherein microwave energy produced by a first source of heating energy is directed downward into said pavement to generate heat internally within the subsurface region of said pavement, the further steps comprising:

applying thermal energy produced by a second source of heating energy to the surface of said pavement to supplement the microwave heating of the uppermost portion of said subsurface region, confining said microwave heating of said pavement and said supplemental heating of the surface thereof to a predetermined fixed area of said pavement which is to be repaired, and filling declivities in said predetermined area of pavement with thermosetting pavement repair material prior to said microwave heating and supplemental heating of said pavement.

8. In a method for heating pavement wherein microwave energy produced by a first source of heating energy is directed downward into said pavement to generate heat internally within the subsurface region of said pavement, wherein said movement is deteriorated pavement to which an overlay of asphaltic concrete pavement is to be applied, the further steps comprising:

applying thermal energy produced by a second source of heating energy to the surface of said pavement to supplement the microwave heating of the uppermost portion of said subsurface region, confining said microwave heating of said pavement and said supplemental heating of the surface thereof to a predetermined fixed area of said pavement which is to be repaired, and spreading a layer of reclaimed oil asphaltic pavement chunks on said predetermined area prior to said microwave heating and supplemental heating thereof whereby said old pavement chunks are heated and decomposed by said microwave heating and supplemental surface heating, and mixing and compacting the decomposed old asphalt pavement materials on said surface following said microwave heating and supplemental heating.

9. Pavement heating apparatus having an energy applicator including microwave heating means for generating heat below the surface of pavement over which said applicator is disposed, further comprising microwave power supply means for energizing said microwave heating means, at least one electrical generator electrically coupled to said microwave power supply means to supply electrical energy thereto, at least one fuel consuming motor coupled to said generator to drive said generator, and heat transmitting means coupled between said motor and said applicator for delivering thermal energy from the exhaust gases of said motor to said pavement wherein said heat transmitting means includes at least one thermally insulative conduit connected between said motor and said energy applicator to transmit at least a portion of the hot exhaust gas of said motor to said pavement over which said energy applicator is positioned.

10. Pavement heating apparatus as defined in claim 9 wherein said energy applicator further comprises a housing having a top and downwardly extending sides formed of electrically conductive material for defining a microwave and hot gas containment region adjacent said surface of said pavement, at least one waveguide for releasing microwave energy into said containment region, said conduit being communicated with said containment region within said housing.

11. In a pavement heating apparatus having energy applicator means for generating heat within the interior of pavement over which said applicator means is disposed by microwave irradiation of said pavement, the improvement comprising:

surface heating means for applying additional heat directly to the surface of said pavement over which said energy applicator means is disposed, wherein said energy applicator means includes a housing having a top and downwardly extending sides formed of electrically conductive material for defining a microwave and hot gas containment region adjacent said surface of said pavement, at least one waveguide for releasing microwave energy into said containment region, and at least one conduit for transmitting hot gas into said housing, and microwave energy trapping means secured to the lower portions of said side walls of said housing for suppressing the outward emission of microwave energy from under said side walls when said housing is spaced above said surface of said pavement by a gap which would otherwise allow the outward release of microwave energy.

12. Pavement heating apparatus as defined in claim 19 further comprising a means secured to the lower portion of said housing for supporting said housing on said pavement in said spaced relationship therewith and for enabling shifting of the position of said housing on said pavement.

13. In a pavement heating apparatus having energy applicator means for generating heat within the interior of pavement over which said applicator means is disposed by microwave irradiation of said pavement, the improvement comprising surface heating means for applying additional heat directly to the surface of said pavement over which said energy applicator means is disposed, wherein said energy applicator means includes a housing having a top and downwardly extending sides formed of electrically conductive material for defining a microwave and hot gas containment region adjacent said surface of said pavement, at least one conduit for transmitting hot gas into said housing, and a plurality of spaced apart horizontally extending waveguides secured within said housing and having microwave emission slits for releasing microwave energy into said containment region.

14. In a pavement heating apparatus having energy applicator means for generating heat within the interior of pavement over which said applicator means is disposed by microwave irradiation of said pavement, the improvement comprising:

surface heating means for applying additional heat directly to the surface of said pavement over which said energy applicator means is disposed, a support vehicle for said energy applicator means, said support vehicle being movable to different locations on said pavement which require heating, and support and positioning linkage means for attaching said energy applicator means to said support vehicle while enabling limiting shifting of the position of said energy applicator means relative to said pavement without requiring movement of said support vehicle itself.

15. Apparatus for heating pavement in depth comprising:

a support vehicle with ground engaging means for facilitating movement between predetermined locations over said pavement, means on said vehicle for generating electrical energy, energy applicator means for directing microwave energy downward into a subjacent area of said pavement, support linkage means for attaching said energy applicator means to said support vehicle while enabling shifting of said microwave applicator means to different selected locations over said pavement without necessarily moving said vehicle, microwave heating means at said energy applicator means for receiving electrical energy from said electrical energy generation means and for producing said microwave energy therefrom, and supplemental surface heating means disposed at said applicator means for maintaining a hot gas environment at the surface of said subjacent area of pavement by utilizing heating energy additional to that produced by said microwave heating means.

16. Apparatus as defined in claim 15 wherein said means for generating electrical energy comprises at least one electrical generator driven by at least one fuel burning motor and wherein said supplemental surface heating means comprises means for transmitting hot exhaust gas from said motor to said energy applicator means.

17. Apparatus as defined in claim 15 wherein said support vehicle has a frame supported on ground engaging means and wherein said support linkage means for attaching said energy applicator to said support vehicle includes an extendable and contractable boom having said energy applicator means coupled thereto and which is pivotally coupled to said vehicle frame for pivoting movement in a horizontal plane and further includes extendable and contractable conduit means for transmitting said hot gas from said vehicle to said supplemental surface heating means.

18. Apparatus as defined in claim 17 wherein said support linkage means further includes means for selectively raising and lowering said energy applicator means relative to said boom.

19. Apparatus for rapidly heating pavement in depth comprising:

a support vehicle with ground engaging means for facilitating movement between predetermined locations over said pavement, wherein said support vehicle has a frame supported on said ground engaging means, means on said vehicle for generating electrical energy, energy applicator means for directing microwave energy downward into a subjacent area of said pavement, support linkage means for attaching said energy applicator means to said support vehicle while enabling shifting of said microwave applicator means to different selected locations over said pavement without necessarily moving said vehicle, wherein said support linkage means for attaching said energy applicator to said support vehicle includes an extendable and contractable boom having said energy applicator means coupled thereto and which is pivotally coupled to said vehicle frame for pivoting movement in a horizontal plane, microwave source means at said energy applicator means for receiving electrical energy from said generation means and for producing said microwave energy therefrom, wherein said boom is pivotally coupled to a subframe supported by said vehicle frame, said subframe being extendable and retractable in a horizontal direction relative to said vehicle frame, and supplemental surface heating means disposed at said applicator means for maintaining a hot gas environment at the surface of said subjacent area of pavement.

20. Apparatus for rapidly heating pavement in depth comprising:

a support vehicle with ground engaging means for facilitating movement between predetermined locations over said pavement, means on said vehicle for generating electrical energy, energy applicator means for directing microwave energy downward into a subjacent area of said pavement, support linkage means for attaching said energy applicator means to said support vehicle while enabling shifting of said microwave applicator means to different selected locations over said pavement without necessarily moving said vehicle, wherein said support linkage means is extendable and contractable and pivotable relative to said support vehicle, motor means for selectively extending contracting and pivoting said support linkage means, microwave source means at said energy applicator means for receiving electrical energy from said generation means and for producing said microwave energy therefrom, and supplemental surface heating means disposed at said applicator means for maintaining a hot gas environment at the surface of said subjacent area of pavement.

* * * * *

UNITED STATES PATENT AND TRADEMARK OFFICE

CERTIFICATE OF CORRECTION

PATENT NO. : 4,252,487

DATED : February 24, 1981

INVENTOR(S) : Morris R. Jeppson

It is certified that error appears in the above—identified patent and that said Letters Patent is hereby corrected as shown below:

Col. 18, line 56
(line 16 of claim 8)

"oil" should be --old--

Col. 19, line 48
(line 1 of claim 12)

"19" should be --11--

Col. 20, line 17
(line 15 of claim 14)

"limiting" should be --limited--

Signed and Sealed this

*Thirty-first* Day of *August 1982*

[SEAL]

*Attest:*

GERALD J. MOSSINGHOFF

*Attesting Officer*

*Commissioner of Patents and Trademarks*